United States Patent [19]

Otsuka et al.

[11] Patent Number: 4,840,296

[45] Date of Patent: Jun. 20, 1989

[54] CLAMPING AND FIXING APPARATUS FOR A REFRACTORY-MADE PLATE FOR A SLIDE GATE VALVE FOR CONTROLLING A MOLTEN STEEL FLOW

[75] Inventors: Takashi Otsuka; Masahiko Nose, both of Okayama; Kenji Yamamoto, Bizen; Tadao Taniguchi, Bizen; Yoshifumi Shigeta, Bizen; Mototsugu Osada, Bizen, all of Japan

[73] Assignee: Shinagawa Refractories Co., Ltd., Japan

[21] Appl. No.: 175,281

[22] Filed: Mar. 30, 1988

[30] Foreign Application Priority Data

Aug. 26, 1987 [JP] Japan ..... 62-128492[U]
Nov. 12, 1987 [JP] Japan ..... 62-171993[U]

[51] Int. Cl.[4] ..... B22D 37/00; B22D 11/00

[52] U.S. Cl. ..... 222/600; 222/591

[58] Field of Search ..... 266/287, 236; 222/590, 222/597, 591, 600

[56] References Cited

U.S. PATENT DOCUMENTS 4,220,269 9/1980 Beckers et al. ..... 222/600
4,265,379 5/1981 Meier ..... 222/600

FOREIGN PATENT DOCUMENTS 0159260 7/1987 Japan ..... 222/600

*Primary Examiner*—S. Kastler
*Attorney, Agent, or Firm*—Larson and Taylor

[57] ABSTRACT

A clamping and fixing apparatus of a refractory-made plate 7 for a slide gate valve for controlling a molten steel flow comprising: providing plate-clamping fixtures 12, 12 rotatably in its plane direction and in contact with the inner side of a casing 13 and a guide piece 11, at both the ends at the plate side, of the guide piece 11 being supported by at least one guide 16 provided within the longer edge sides of the casing 13 which houses the refractory-made plate 7; inserting idly a nut 10 into a dovetail groove recess 11*a* provided in the other area of said guide piece 11; mounting to said nut 10 a bolt 9 which is rotatable passing through said casing 13; and providing said fixtures 12, 12 with respective surfaces of contracting the plate 7.

4 Claims, 4 Drawing Sheets

PRIOR ART

PRIOR ART

CLAMPING AND FIXING APPARATUS FOR A REFRACTORY-MADE PLATE FOR A SLIDE GATE VALVE FOR CONTROLLING A MOLTEN STEEL FLOW

This invention relates to a clamping and fixing apparatus of a refractory-made plate (hereinafter called a plate) for a slide gate valve for controlling a molten steel flow, which apparatus is used when a molten steel is poured out of a vessel for molten steel, such as a ladle or tundish.

By the refractory-made plate in the present invention is meant a bottom plate, a slide plate or a seal plate which is used for said slide gate valve for controlling a molten steel flow.

As known fixing means there can be mentioned a method (Japanese Utility Model Kokai or Unexamined Utility Model Publication No. 115607/77) of fixing a plate at the flat surface of its shorter edge side, as shown in FIGS. 3 and 4, and a method (Japanese Patent Kokai No. 159260/86) of fixing the plate at its tapered surface, as shown in FIGS. 5 and 6. In these methods the plate is fixed by pressing a plate fixture 2 (or 4, 5 or 6) against the plate by means of a cotter 1 or a bolt 3. However, these methods have the following demerits:

(1) In the method of fixing the plate at its flat surface, it is not effective for controlling vertical cracking of the plate but rather it accelerated such cracking thereby shortening the life of the plate.

(2) In the method of fixing the plate at its tapered surface, it is effective for controlling the vertical cracking, but according to the known means the plate fixture 5 or 6 is likely to be deformed due to the pressing force of the plate so as to allow the fixture to be spread outwardly. On the other hand, to prevent the deformation it is necessary to make the fixture with considerably a large dimension.

Being caused by the deformation of the plate fixture and the irregular dimensions of manufacturing plates, as described above, a surface contact at a tapered surface becomes difficult thereby causing a point or linear contact and concentrating a stress to the plate. This causes crackings to the plate.

(3) The bolt 3 shown in FIGS. 4 and 6 sometimes is seized by dust, heat load and the like. In such a case it is not easy to dismantle the bolt, and in the worst case not only the bolt but also a casing 13 may be damaged.

Under the circumstances it is earnestly desired to prevent the aforementioned occurrence of cracking to plates and the deformation of a plate fixture and to effect an easy and accurate setting of the plates despite the irregular dimensions of the plates.

To solve the various problems given in the aforementioned known means the inventors of this invention have conducted various researches and experiments, and as a result they have succeeded in developing the present invention. Though the technical constitution of the invention is as clearly described in the claims, the invention will now be described more in detail by way of an embodiment with reference to the accompanying drawings.

Figure 1:
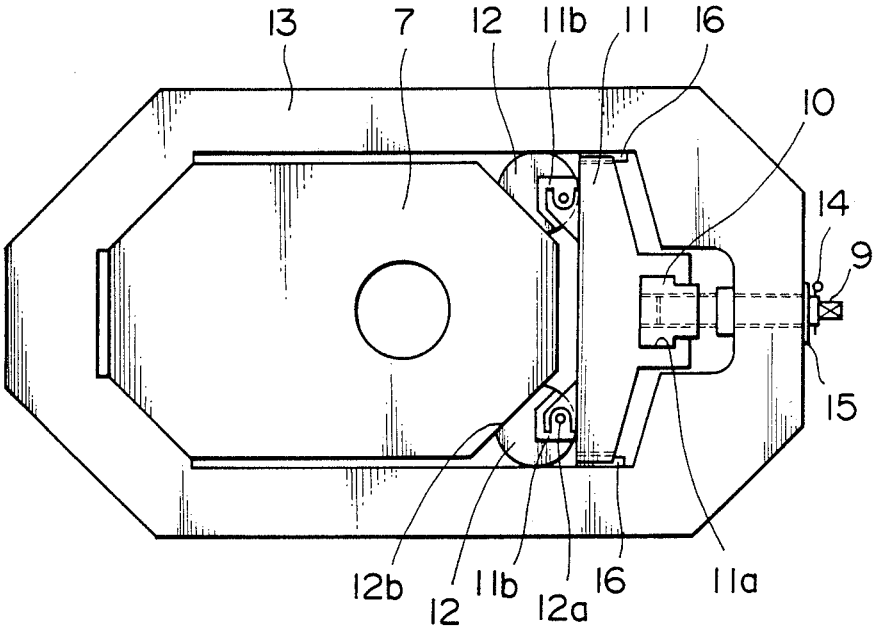
FIG. 1 is a plan view of the apparatus of this invention.

As illustrated, reference numeral 13 designates a casing for housing a slide plate, and guides 16, 16 are projectingly provided at two sides within the longer sides of said casing. A guide piece 11 projects brackets 11*b*, 11*b* for engaging with fixtures 12, 12 at the plate 7 side, said brackets anchoring the fixtures 12, 12 rotatably in their plane direction. In the drawings, recessed grooves engaging projections 12*a*, 12*a* provided in the fixtures 12, 12 are provided respectively in the brackets 11*b*, 11*b*, as illustrated. Said fixtures 12, 12 are provided with plate-contacting surfaces 12*b*, 12*b*, and each fixture 12 is constructed in such a manner that it has a sufficient dimension so that part of its peripheral surface may be brought into contact with the inner surface of said casing 13 and the guide piece 11. Additionally, said guide 16 may often be a single one.

The guide piece 11 is provided with a dovetail groove recess 11*a* at the side opposite to the plate 7, and a nut 10 is idly inserted in the recess 11*a*, said nut being mounted at one end of a bolt 9 which rotates passing through said casing 13, as illustrated.

Figure 2:
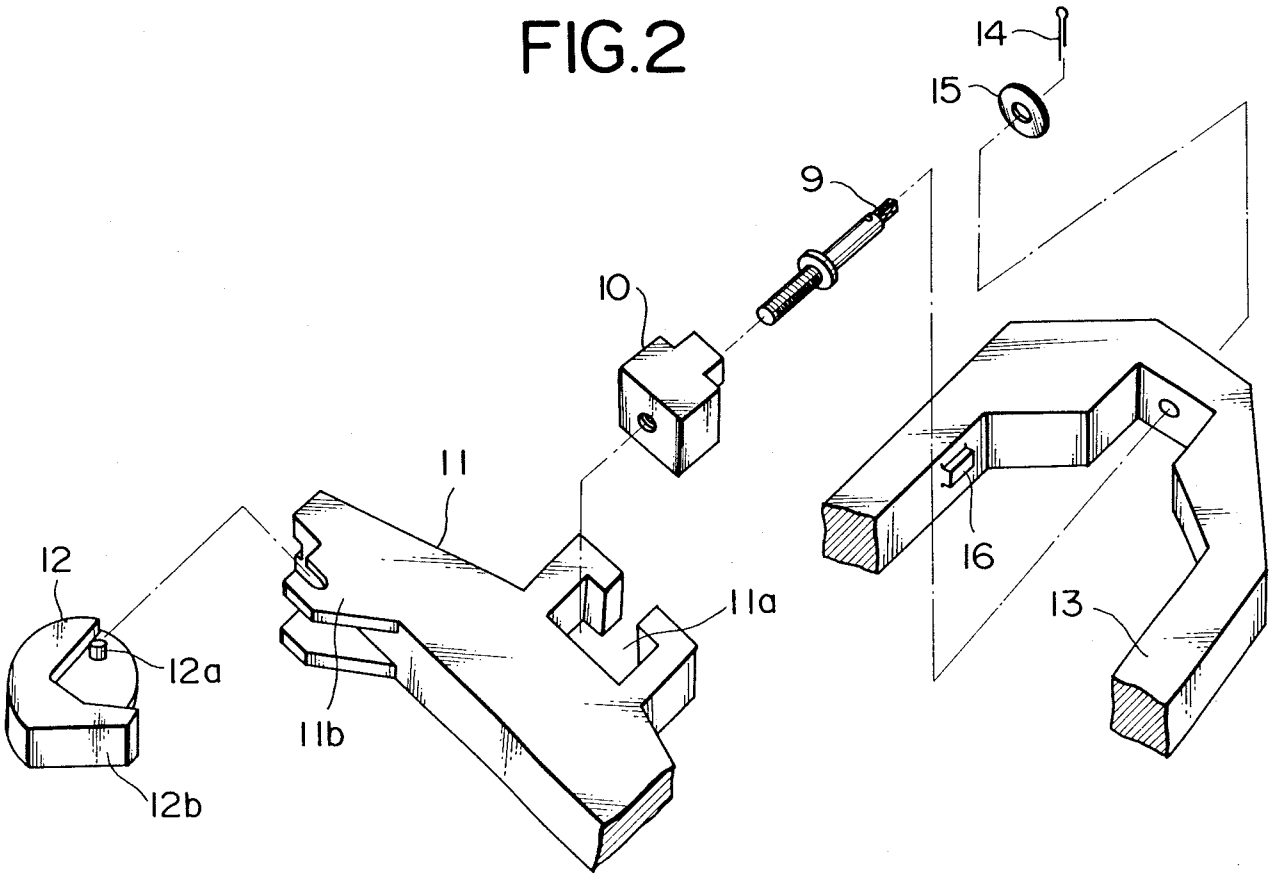
FIG. 2 is a developed, perspective view of said apparatus.
Figure 3:
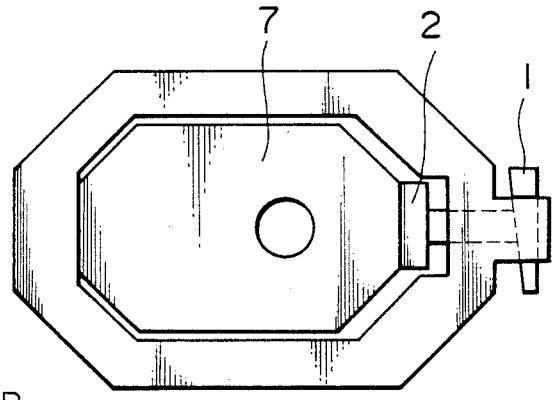
FIGS. 3–6 are plan views of various prior art devices discussed above.
Figure 4:
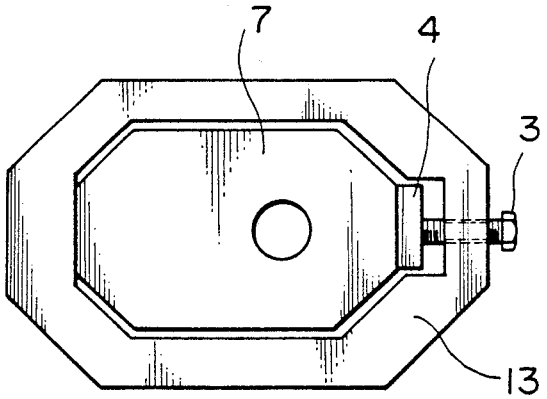
PRIOR ART FIG.4
Figure 5:
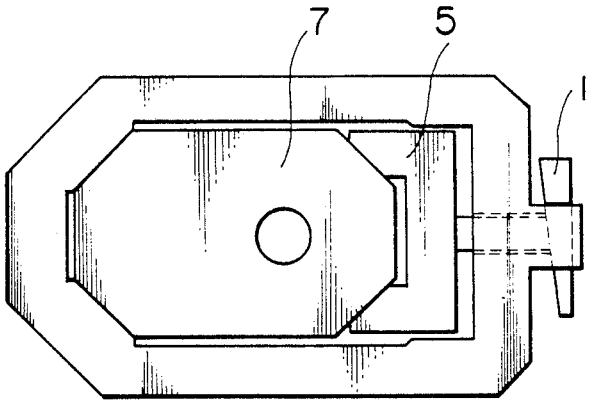
Figure 6:
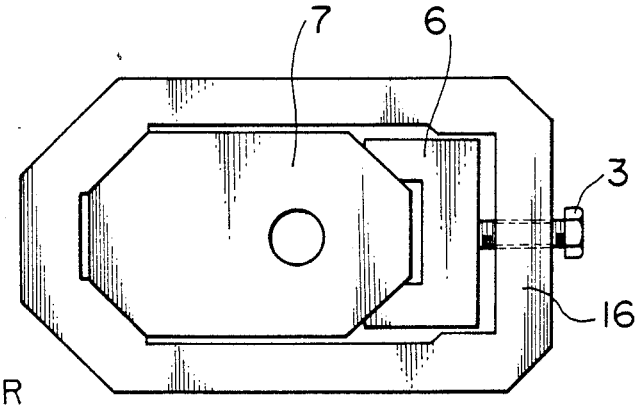
PRIOR ART FIG.6

The apparatus of this invention, which is constructed as described above, is assembled and operated as follows. The assembling is made within the casing 13 as shown with one-point broken lines in FIG. 2, and when the bolt 9 is clamped the guide piece 11 and the fixture 12 supported by said guide piece move toward the plate 7 thereby to fix said plate. At this time, each of the fixtures 12, 12 is brought into contact with the casing 13 and the guide piece 11, at a point of its peripheral surface, and it is in contact with the tapered portion of the peripheral surface of the plate, at its contact surface 12*b*. Since the fixture 12 thus rotates following the different taper angles of different plates 7 the portion of fixing plates 7 makes always a surface contact with the plates, and therefore stress is not concentrated on them.

Further, the present apparatus is designed in such a manner that the plate 7 is contact supported at two places of the casing 13 and the guide piece 11 so as to disperse the force generated by the thermal expansion of the plate 7 when in use, i.e. the force caused by the plate pressing. From the strength point of view each portion of the present apparatus can be made compact. Furthermore, in case the screwing portion of said nut 10 and bolt 9 have been sized so as not to move, the nut 10 and the bolt 9 can easily be disengaged from the guide piece 11 by moving the bolt 9 toward the plate 7 to remove it from the casing 13, whereby parts can be replaced very easily.

Though the present invention has been described above by way of an example of slide plates it will be evident to those skilled in the art from the above teachings that it is also possible to clamp and fix the plates even in the case of bottom plates or seal plates by means of the same structure as in the present apparatus.

In conclusion the clamping and fixing apparatus of this invention has the following merits:

(1) Each of the fixtures 12, 12 is mounted to the guide piece 11 rotatably in the plane direction and it necessarily makes a surface contact with the tapered surface of the plate 7, so that stress is not concentrated on the plate.

(2) Since the fixture 12 is supported at two places of the casing 13 and the guide piece 11 it is possible to disperse the pressing force of the plate to both the casing 13 and the guide piece 11. Thus the force which acts on the guide piece 11 is reduced so that it becomes to be hardly deformed.

(3) Since the nut 10 is mounted disengageably from the guide piece 11, the screwing portion can be easily replaced even when it has been seized.

We claim:

1. A clamping and fixing apparatus for a refractory plate (7) located in a casing (13) of a slide gate valve which controls a molten steel flow comprising:

a guide piece (11) located in the casing (13) having a first side adjacent an end of the refractory place (7) and an opposite second side adjacent an end of the casing (13), said guide piece (11) also having opposite ends adjacent a respective opposite side of the casing (13);

a guide means for guiding said guide piece for movement toward and away from the refractory plate (7) between a clamped position and an unclamped position;

a respective plate-clamping fixture (12) located at a respective said end of said guide piece (11), each said fixture (12) including a peripheral surface which contacts the adjacent side of the casing (13) and said guide piece (11) when said guide piece (11) is moved to the clamped position, as well as a planar portion (12*b*) of said peripheral surface which engages a complementary angled planar surface at the end of the plate (7);

a mounting means (11*b*, 12*a*) for rotatably mounting a respective said fixture (12) to a respective said end of said guide piece (11) for rotation in a plane parallel to the plate (7); and a moving means for moving said guide piece (11) between the clamped and unclamped positions.

2. A clamping and fixing apparatus of a refractory-made plate 7 as set forth in claim 1 wherein said plate made of a refractory is at least one of a bottom plate, a slide plate and a seal plate.

3. A clamping and fixing apparatus as claimed in claim 1 wherein each said fixture (12) includes a first curved portion of said peripheral surface which engages the casing (13), and a second curved portion of said peripheral surface which engages said guide piece whereby variations in the angled planar portion of the plate are easily accommodated.

4. A clamping and fixing apparatus as claimed in claim 1 wherein said moving means includes (a) a dovetail groove recess (11*a*) provided in said guide piece (11) adjacent said second end, (b) a nut (10) which is received in said dovetail groove recess, (c) a bolt (9), and (d) a mounting means for releasably and rotatably mounting said bolt (9) in the end of the casing (13) with said bolt (9) threadably received in said nut (10) whereby rotation of said bolt (9) causes said guide piece (11) to move between the clamped and unclamped positions and said bolt is also easily removable from the casing.

* * * * *